United States Patent [19]

Dirla et al.

[11] Patent Number: 4,729,677

[45] Date of Patent: Mar. 8, 1988

[54] TYPEWRITER RIBBON CASSETTES WITH MULTIPLE TYPING TRACKS

[75] Inventors: Manfred Dirla, Overath; Markus Trabelsi, Wuppertal, both of Fed. Rep. of Germany

[73] Assignee: Regentrop & Bernard GmbH, Wuppertal, Fed. Rep. of Germany

[21] Appl. No.: 898,118

[22] Filed: Aug. 20, 1986

[30] Foreign Application Priority Data

Aug. 20, 1985 [DE] Fed. Rep. of Germany ..... 3529750

[51] Int. Cl.[4] ..... B41J 35/04

[52] U.S. Cl. ..... 400/208; 400/234

[58] Field of Search ..... 400/207, 208, 208.1, 400/234

[56] References Cited

FOREIGN PATENT DOCUMENTS 0118238 9/1984 European Pat. Off. ..... 400/248

*Primary Examiner*—Edgar S. Burr
*Assistant Examiner*—James A. Lisehora
*Attorney, Agent, or Firm*—Shapiro and Shapiro

[57] ABSTRACT

Typing ribbon cartridge for typewriting and/or printing machines in which a typing ribbon (2) has a section that runs freely outside the cartridge housing between two housing side-arms (4). To select one of several typing tracks this section is moved perpendicularly to the longitudinal axis of the ribbon section in such a way that equalization of the differing tensions of the ribbon edges in the various positions of the free section of the ribbon is obtained. For this purpose guide elements (9) are provided, which are mounted on guide edges of the side-arms (4), which are arranged perpendicular to the longitudinal axis throughout their entire length and in the ribbon plane, and the guide elements are tiltable about axes (15), which are arranged perpendicular to the plane of the free section of the ribbon and which intersect the guide edges.

4 Claims, 6 Drawing Figures

TYPEWRITER RIBBON CASSETTES WITH MULTIPLE TYPING TRACKS

Figure 1:
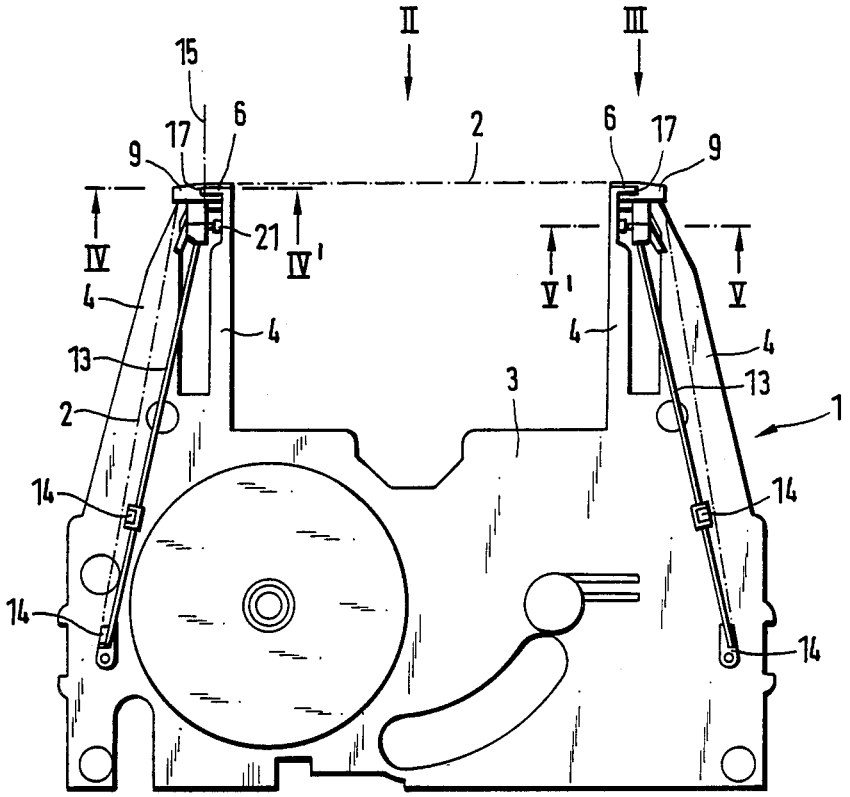

The invention concerns a typing ribbon cartridge for typewriting and/or printing machines consisting of a housing with a housing base and two housing side-arms, a typing ribbon, a take-off reel, a take-up reel, and drive elements controlled by the machine for moving the typing ribbon along, whereby the typing ribbon runs freely outside the housing between the two housing side-arms, and the housing side-arms have guide pieces lying in a plane which is parallel to the plane of the ribbon in the area of the free ribbon section, which pieces have guide edges which face outwards and away from one another, on which the typing ribbon is passed by means of guide-elements which serve to select one of several typing tracks in the plane of the ribbon, movable perpendicularly to the longitudinal axis of the free ribbon section, in such a manner that an equalization of various tensions of the ribbon edges in the various positions of the free section of the ribbon is provided.

In such typing ribbon cartridges, the typing ribbon is passed free in a section between two side-arms, in front of the roller of the machine, and past the type-face impact point. One of several typing tracks of the ribbon is selectable by means of a guide of the ribbon in its transverse direction which is controllable by the machine, i.e. by means of the parallel displacement of the ribbon. In this regard, it is disadvantageous that, due to the transverse movement of the freely-guided section of the ribbon, the tension of the ribbon is not constant, but rather varies, depending on the track selected, such that two ribbon edges have different tensions, especially in the areas of the uppermost and lowermost typing tracks. This may lead to a reduction in quality of the typing or, in the most unfavorable cases, even to catching of the ribbon on the type faces, especially when using machines with daisy wheels; this may lead to damage to the ribbon or to the daisy wheel.

A typing ribbon cartridge is already known in which the disadvantage is to be avoided by having the housing side arms provide guide pieces for the guide elements directed outward, i.e., away from one another. The guide elements are equipped with U-shaped slits, which are placed on the guide pieces. In this connection, it is provided that the guide pieces have an edge with a convex profile so that the guide elements move on a circular path. in this way, the distances between the marginal zones of the ribbon guides are not constant, but rather are variable, depending on the typing track selected in each case. However, in order to achieve a completely equal tension of the two ribbon edges in this way, a very exact calculation of the arc of the circle, i.e., of the convex arc of the guide piece edges, is required, since this type of guide is a force-guide. In this way, a mistakenly-selected arc would continue to make it possible for the edges of the ribbon to have differing tensions. Moreover, due to the guiding by the guide elements along the guide-edges, which are bent outward convexly, the distance between the guide elements is not constant, i.e., the distance between them is greater at the point of the central typing track than at the points of the upper and lower typing tracks. Since the ribbon is moved with each stroke of the machine from the lower initial position to the position of the typing track selected in each case, due to the increase in the distance between the guide elements, a greater amount, determined by this difference, of the ribbon is pulled away from the ribbon roll during movement to the central and lower typing tracks than what would correspond to the conveyance step of the drive wheel of the machine. This, however, causes a reduced yield form the ribbon.

The invention is therefore based on the problem of improving the typing ribbon cartridge described such that a completely equal and optimal ribbon tension in all positions of the ribbon is achieved, with optimal utilization of the ribbon and with a ribbon guide of simple construction.

This is achieved inventively by having the guide edges of the guide pieces arranged perpendicular to the longitudinal axis of the free ribbon section throughout their entire length, and having the guide elements fixed on the guide edges in such a way that they are tiltable about axes which are arranged so as to be perpendicular to the plane of of the free section of the ribbon, and which intersect the guide edges. Consequently, no force-guide is provided, as is the case with the known ribbon cartridges; rather, it is inventively essential that the ribbon itself regulates the required equalization by means of the provision of tiltability of the guide elements, based on the different ribbon tension of its edges. In this way, the tension equilibrium is always optimal across the entire width of the ribbon, and in all positions of the ribbon. Advantageously, the guide edges run straight and parallel to one another, so that the distance between the guide elements is constant over the course of their path along the guide edges. In this way, the amount of ribbon pulled off the supply roll is constant at all ribbon positions, i.e., it is independent of the typing track involved, which results in optimal ribbon yield.

Additional advantageous embodiment characteristics of the invention are contained in the subordinate claims and the following description.

Figure 2:
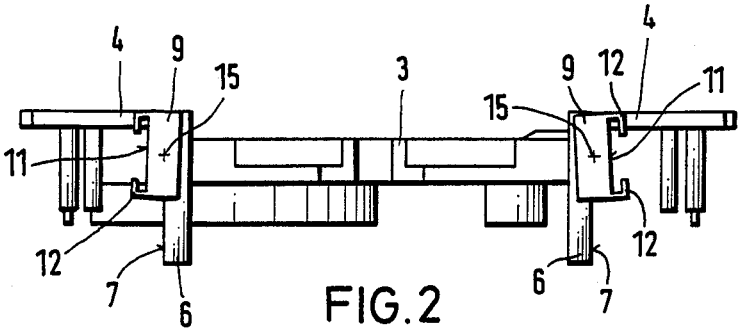
Figure 3:
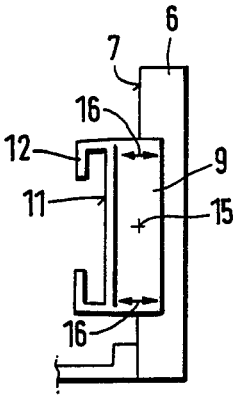
Figure 4:
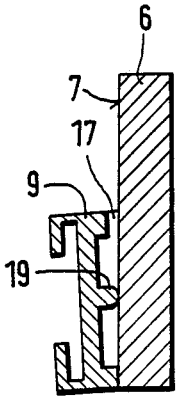
Figure 5:
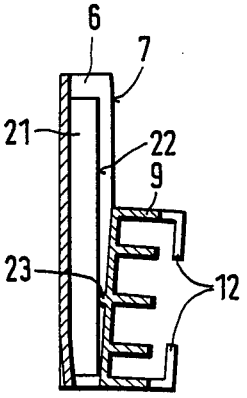
Figure 6:
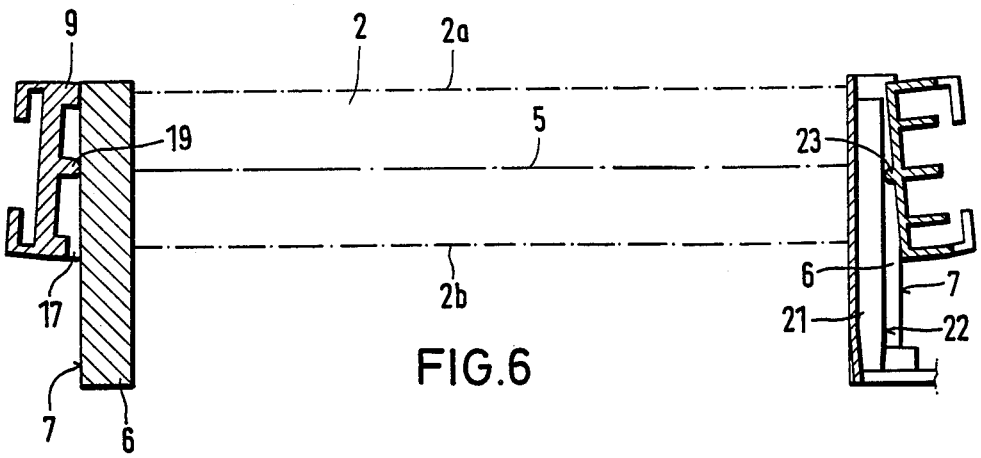

The invention will be explained in greater detail below, by reference to embodiment examples represented in the drawing, as follows:

FIG. 1: an interior view of a lower piece of a housing of an inventive typing ribbon cartridge;

FIG. 2: a view in the direction of the arrow according to FIG. 1;

FIG. 3: an enlarged view, as compared to FIG. 1, in the direction of Arrow III according to FIG. 1;

FIG. 4: a longitudinal section along the line IV—IV' according to FIG. 1, enlarged as compared to FIG. 1;

FIG. 5: a longitudinal section along the line V—V' according to FIG. 1, enlarged as compared to FIG. 1; and FIG. 6: a longitudinal section along the line IV-V according to FIG. 1, enlarged as compared to FIG. 1.

In FIG. 1, a lower portion of the housing of an inventive typing ribbon cartridge is represented. In order to make an overview possible, the cartridge lid and the reels are not represented. The path of a typing ribbon 2 is represented by a dotted line. The cartridge housing consists of a housing base 3, in which the spools with the rolled-up ribbon 2 are located, and two housing side-arms 4, which extend forward from the housing base 3, i.e., in the direction of the impact roller, when the cartridge is emplaced in the machine. Between the housing side-arms 4, the typing ribbon 2 runs free outside the housing between the impact roller and the type-faces of the machine. In this section, the ribbon 2 is passed in such a way as to be movable perpendicularly to the longitudinal axis of the ribbon 5 (FIG. 6) and in the plane of the free ribbon section, i.e., in FIG. 1, perpendicularly to the plane of the drawing, in order to select one of several typing tracks.

As can be seen in FIG. 2, the housing side-arms 4 have guide pieces 6 in a plane running parallel to the plane of the ribbon in the free section of the ribbon, which pieces have guide-edges 7 pointing outward, i.e., away from one another. Guide elements 9 are mounted movably on these guide edges 7, which have support edges 11 for guiding the ribbon 2. The ribbon 2 is passed over the support edges 11 in such a way that it is simultaneously steered from the direction of the side arms 4 into the direction of the free ribbon segment. In order to safely guide the typing ribbon 2 into its transverse direction, the guide elements 9 have extensions 12 in the side areas of the support edges 11 which laterally reach around the ribbon 2 and thus prevent the ribbon 2 from sliding off the support edges 11.

According to FIG. 1, the guide elements 9 are maintained in a certain position by means of rod-shaped wire springs 13 which extend longitudinally through the housing side arms 4, which position is advantageously that in which the uppermost typing track of the typing ribbon 2 passes in front of the impact point of the machine. The pre-tension of the springs 13 required for this is achieved by means of supports 14, which are built into the lower part of the housing 1. By means of manipulation of the machine, the movement of the ribbon 2 for selection of further typing tracks occurs against the pre-tension of the springs 13. Since the typing ribbon 2 is movable in the free ribbon section between the housing side-arms 4 in the direction of the plane of the ribbon and perpendicularly to the longitudinal axis of the ribbons 5—see FIG. 6—but the reels in the housing base 3 do not change their positions, the tensions of the ribbon edges 2*a* and 2*b* are not constant, so that in the ribbon position represented in FIG. 6, edge 2*a* would have a greater tension than edge 2*b*.

In order to avoid this, it is inventively provided—as represented in FIG. 3—that the guide edges 7 of the guide pieces 6 be arranged perpendicularly to the longitudinal axis of the ribbon 5 throughout their entire length, i.e., the guide edges are straight. The guide pieces 9 are advantageously mounted on the guide edges 7 in such a way that they are tiltable (as shown by arrows 16 in FIG. 3) about axes 15 (FIG. 1) which are arranged so as to be perpendicular to the plane of of the free section of the ribbon, and which intersect the guide edges 7.

FIGS. 1, 4 and 6 show that the guide elements 9 have guide grooves 17 for laying upon the guide edges 7, in the middle of each of which grooves a cam 19 is installed to generate the tiltability of the guide elements 9.

As represented in FIGS. 1, 5 and 6, each housing side arm 4 advantageously has a further guide piece 21, which is installed parallel to the first guide piece in a plane between the free ribbon section and the housing base 3. These second guide pieces 21 have straight guide edges 22 which are analogous to the guide edges 7 of the first guide pieces 6, and parallel to these edges. The guide elements 9 advantageously rest on the second guide edges 22 with additional cams 23. By means of this advantageous embodiment, a tilt of the guide elements 9 in some direction other than the one described and permitted is prevented, so that a safe guiding of the ribbon 2 is provided.

In FIG. 2, the tilt position of the guide elements 9 in the lowest position of the ribbon for selection of the upper typing track is represented; FIG. 3 shows the medial position, and FIG. 6 the selected position for the lower typing track. This shows that the ribbon 2 can itself set the tilt position of the guide elements 9 based on the differing tensions of its edges, by means of the support edges 11, so that the most optimal ribbon tension constancy throughout the width of the ribbon is always provided.

By having the cams 19 and 23 each rest on the straight guide edges 7 and 22, respectively, the distance between the guide elements 9, i.e., the central area of the support edges 11, remains constant. Only the distance between the marginal areas of the support edges 11 of the two guide elements is variable due to the tiltability of the guide elements 9. In this way, the present invention provides an equalization of varying tensions of the ribbon edges, while at the same time providing optimal ribbon utilization.

We claim:

1. A typing ribbon cartridge for typewriting and/or printing machine comprising a housing with a housing base and two housing side-arms, and a typing ribbon with a free ribbon section outside the housing between the two housing side-arms, each housing sidearm having a guide piece lying in a plane which is parallel to the plane of the free ribbon section, the guide pieces having guide edges facing outwardly away from one another and over which the typing ribbon is passed by means of guide elements the guide elements being movable in the plane of the free ribbon section transverse to the longitudinal axis of the free ribbon section in order to move the free ribbon section to different positions for selecting one of several typing tracks, the typing ribbon cartridge being characterized by the fact that the guide edges of the guide pieces are straight and are perpendicular to the longitudinal axis of the free ribbon section throughout their entire length, and by means tiltably mounting the guide elements on the guide edges in such a way that they are tiltable relative to the guide pieces about axes which are perpendicular to the plane of the free ribbon section and which intersect the guide edges, whereby tension of the ribbon edges for different positions of the free section of the ribbon is equalized.

2. A typing ribbon cartridge according to claim 1, further characterized by the fact that each guide element has a guide groove for mounting the guide element on a guide edge, and said means for tiltably mounting includes a cam in the middle of the guide groove, said guide elements being tiltable about the cams, respectively.

3. A typing ribbon cartridge according to claim 2, further characterized by the fact that each housing side-arm has an additional guide piece which is arranged parallel to a first-mentioned guide piece of that side-arm in a plane between the free ribbon section and the housing base.

4. A typing ribbon cartridge according to claim 3, further characterized by the fact that each of said additional guide pieces has a second guide edge parallel to the guide edge of the first-mentioned guide piece of the same housing side-arm, and each guide element has an additional cam resting on the second guide edge of the same housing side-arm.

* * * * *